US005460516A

United States Patent [19]

Sher

[11] Patent Number: 5,460,516

[45] Date of Patent: Oct. 24, 1995

[54] SAFETY LIGHTER WITH LOCKING STRIKER WHEEL

[75] Inventor: Tak C. Sher, North Point, Hong Kong

[73] Assignees: Polycity Industrial Ltd.; Tak Fi International (Holdings) Ltd., both of Quarry Bay, Hong Kong

[21] Appl. No.: 296,365

[22] Filed: Aug. 24, 1994

[51] Int. Cl.[6] ..... F23D 11/36

[52] U.S. Cl. ..... 431/277; 431/153

[58] Field of Search ..... 431/153, 277, 431/273, 274, 275, 276, 136, 137, 138, 140, 141

[56] References Cited

U.S. PATENT DOCUMENTS

| | | | |
|---|---|---|---|
| 1,746,949 | 2/1930 | Kollstede | 431/137 X |
| 1,762,079 | 6/1930 | Rubsamen | 431/136 |
| 2,262,806 | 11/1941 | Kempf et al. | 431/137 X |
| 2,449,414 | 9/1948 | Rogers | 431/139 |
| 2,795,945 | 6/1957 | Coenders | 431/136 X |
| 3,079,781 | 3/1963 | Virtanen | 431/137 X |
| 4,717,335 | 1/1988 | Loveless | 431/277 |
| 5,066,220 | 11/1991 | Vick | 431/277 |
| 5,074,781 | 12/1991 | Fujita | 431/277 X |
| 5,085,578 | 2/1992 | Hunter | 431/277 |
| 5,092,764 | 3/1992 | McDonough et al. | 431/277 |
| 5,104,313 | 4/1992 | Zellweger | 431/277 |
| 5,165,885 | 11/1992 | Iwahori | 431/153 |
| 5,197,870 | 3/1993 | Yang | 431/153 |
| 5,213,495 | 5/1993 | Pan | 431/344 |
| 5,215,458 | 6/1993 | Cirami | 431/277 |
| 5,224,854 | 6/1993 | Ansquer | 431/277 X |
| 5,271,731 | 12/1993 | Hsin-Chung | 431/254 |

FOREIGN PATENT DOCUMENTS

| | | | |
|---|---|---|---|
| 0296281 | 12/1988 | European Pat. Off. | 431/153 |
| 495249 | 10/1919 | France | 431/273 |
| 745844 | 5/1933 | France | 431/273 |
| 819929 | 9/1951 | Germany | 431/136 |

*Primary Examiner*—Carl D. Price
*Attorney, Agent, or Firm*—Ladas & Parry

[57] ABSTRACT

In a preferred embodiment of the invention, the lighter comprises an igniter having a striker wheel which may rotate about an axis first in a clockwise direction and second in a counter-clockwise direction when the wheel is viewed from its side. A stopping means is mounted on the wheel so that its range of movement at least in the clockwise direction is limited. It is while the wheel is being rotated in its clockwise direction that it and the igniter's flint may cooperate together to create a spark which ignites the lighter fuel. When the wheel is rotated in the counter-clockwise direction, no spark is created. When the wheel has been rotated to its extreme limit of its clockwise movement, the lighter can no longer be ignited unless the wheel is moved in accordance with two separate actions, that is, first rotating the wheel in the counter-clockwise direction and then back in the clockwise direction. Because two separate movements are required, the chances that the lighter will be accidentally made operational are reduced, as is the likelihood that a child will light the lighter.

2 Claims, 9 Drawing Sheets

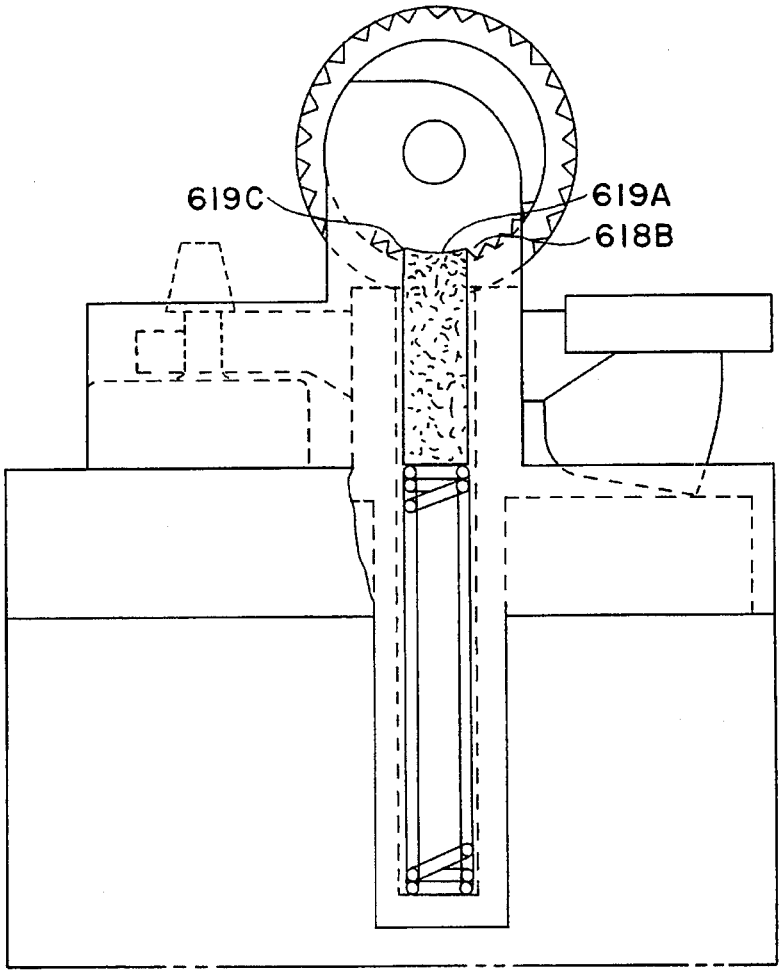
FIG. 11
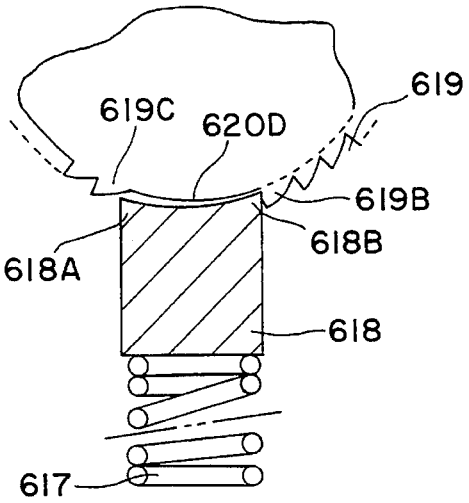
FIG. 11-A

SAFETY LIGHTER WITH LOCKING STRIKER WHEEL

BACKGROUND OF THE INVENTION

This invention relates to the field of lighters, such as cigarette lighters. Modern butane lighters have become very popular. One of the reasons for their popularity is that the height of the flame produced by the lighter can be varied over a wide range by varying the amount of fuel allowed to be ejected from the lighter. The very feature that makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Modern butane lighters are particularly dangerous when they are in the hands of children.

The invention disclosed herein substantially reduces the risk that a lighter will be ignited either by accident or by a child.

SUMMARY OF THE INVENTION

Conventional lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker, flint and flint-spring combination, which igniter is positioned close to the rear end of the lever so that the igniter and the rear end of the lever may be actuated nearly simultaneously. When this occurs, a flame is caused to be ignited from the head of the nozzle from which fuel is being ejected while the rear end of the lever is being held down.

Lighters which pre-date modern butane lighters are similar to the above-identified conventional lighters except that instead of having a nozzle in connected relationship with the reservoir, a wick or similar device is used, and there is no need for a nozzle actuating lever.

The safety device of the present invention works effectively with either form of lighter.

In a preferred embodiment of the invention, the lighter comprises an igniter having a striker wheel which may rotate about an axis first in a clockwise direction and second in a counter-clockwise direction when the wheel is viewed from its side. A stopping means is mounted on the wheel so that its range of movement at least in the clockwise direction is limited. It is while the wheel is being rotated in its clockwise direction that it and the igniter's flint may cooperate together to create a spark which ignites the lighter fuel. When the wheel is rotated in the counter-clockwise direction, no spark is created. When the wheel has been rotated to its extreme limit of its clockwise movement, the lighter can no longer be ignited unless the wheel is moved in accordance with two separate actions, that is, first rotating the wheel in the counter-clockwise direction and then back in the clockwise direction. Because two separate movements are required, the chances that the lighter will be accidentally made operational are reduced, as is the likelihood that a child will light the lighter.

BRIEF DESCRIPTION OF THE DRAWINGS

FIGS. 11 and 11(*a*) are a partial side elevational view of the lighter of the second embodiment of the present invention, partially broken away and sectioned, illustrating the lighter of the second embodiment of the present invention in its safety position.

DETAILED DESCRIPTION OF THE INVENTION

Figure 1:
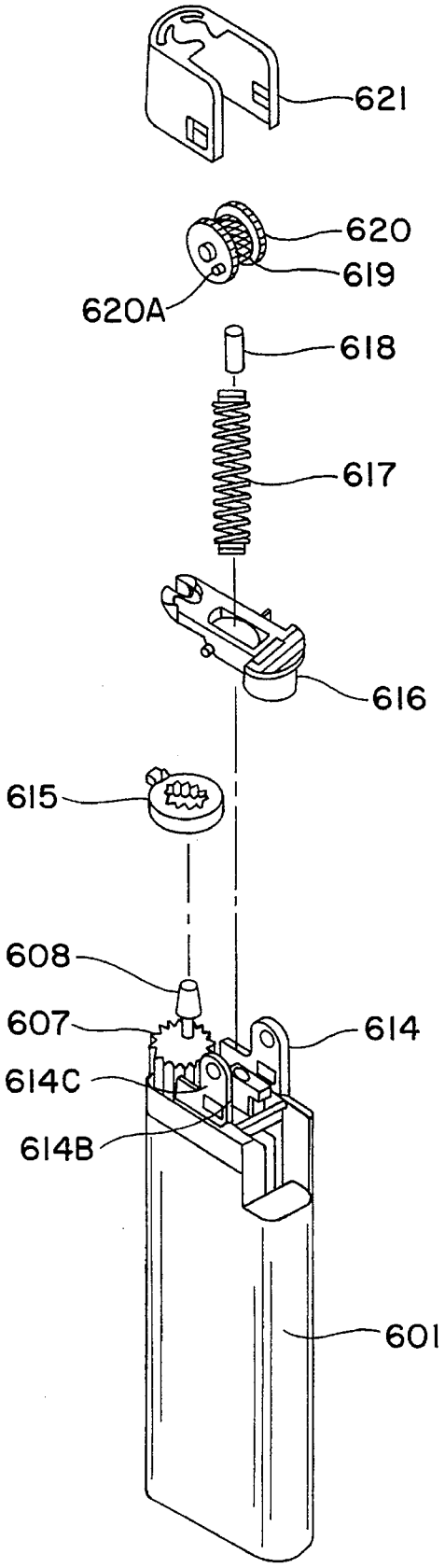
FIG. 1 is an exploded view of a first embodiment of the safety lighter of the present invention.
Figure 2:
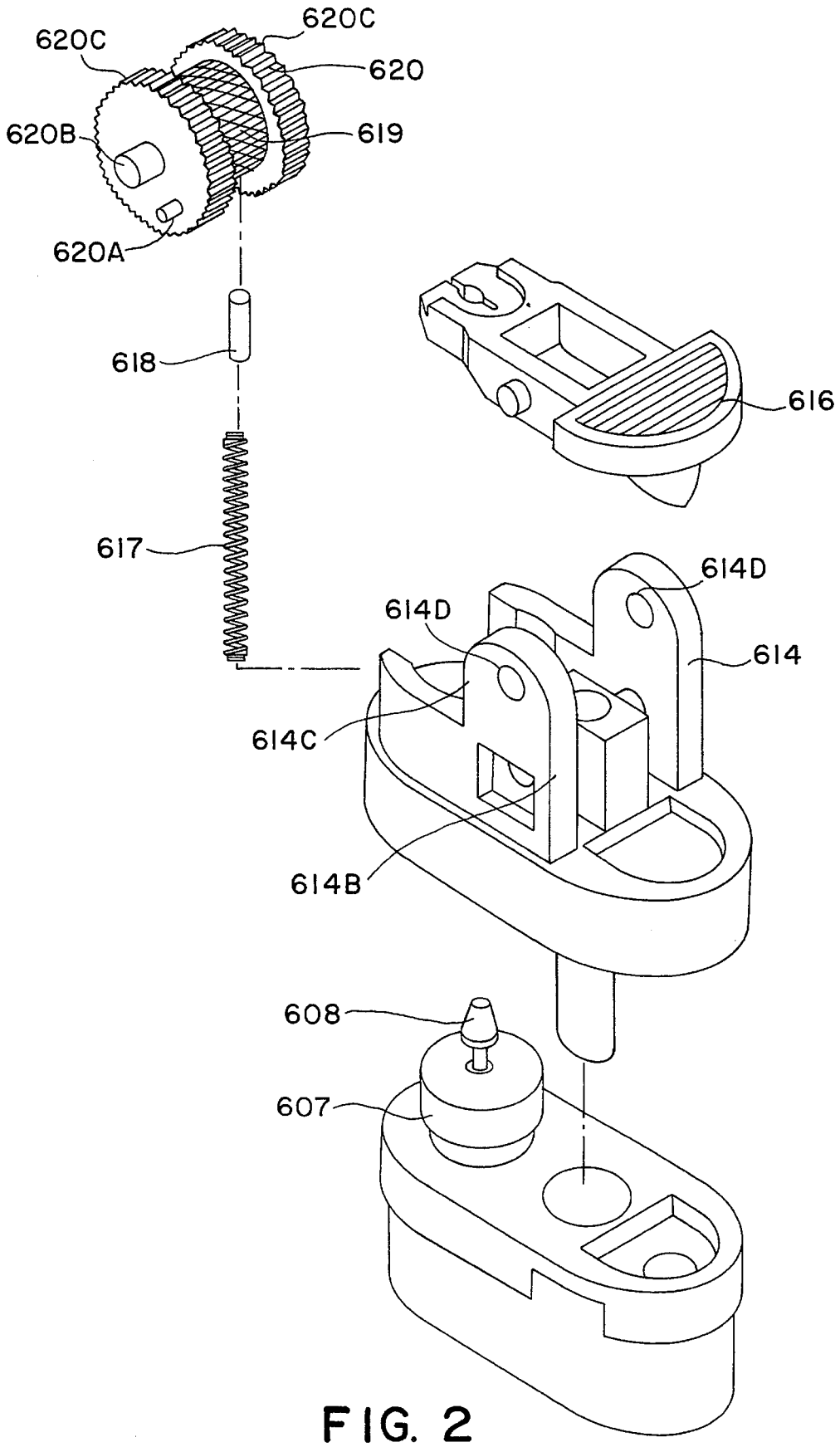
FIG. 2 is a detailed view of that portion of the lighter shown in FIG. 1 which more clearly shows the inventive aspects of the present invention.

The preferred embodiments of the invention are illustrated in the attached drawings which are referred to herein. The same reference numeral will be used to identify identical elements throughout the drawings.

Figure 9:
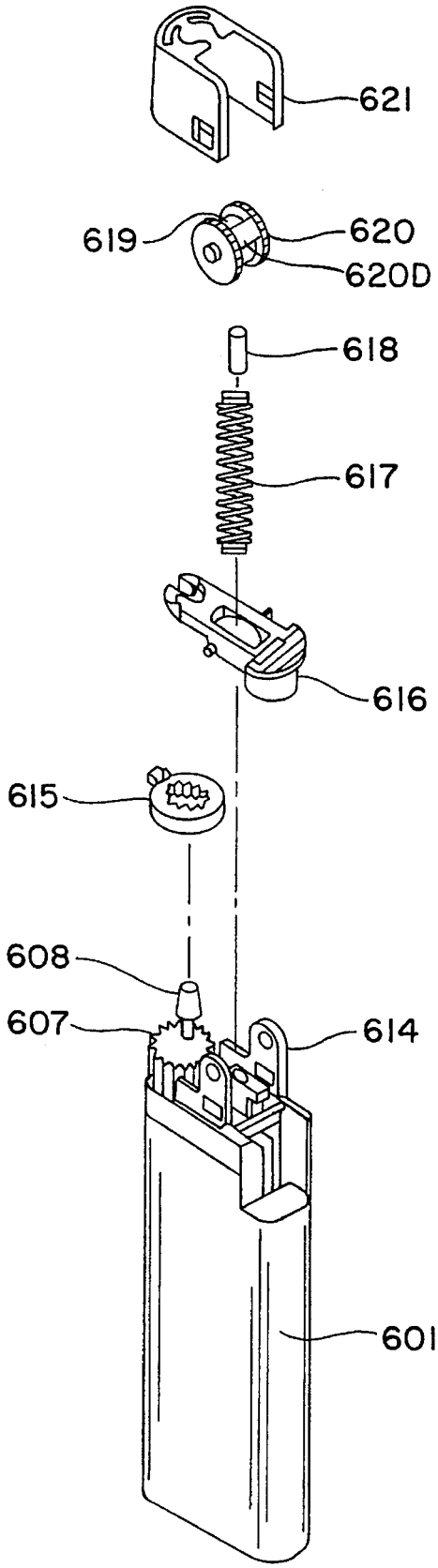
FIG. 9 is an exploded view of a second embodiment of the safety lighter of the present invention.
Figure 10:
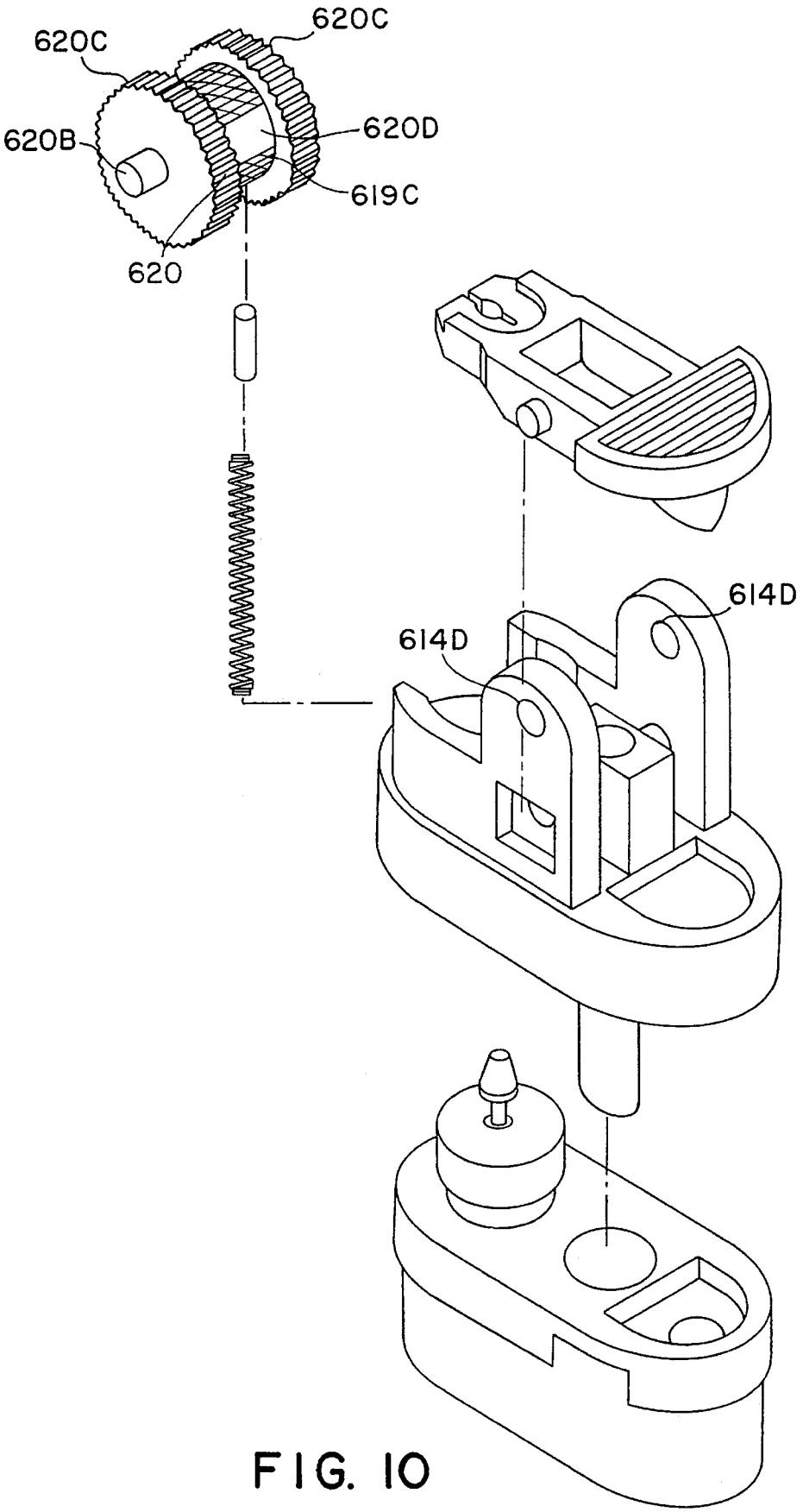
FIG. 10 is a detailed view of that portion of the lighter shown in FIG. 9 which more clearly shows the inventive aspects of the present invention.

FIGS. 1 and 9 illustrate components commonly mounted on a lighter body 601 in which lighter fuel is contained. Such components include nozzle 608 having a head and a downwardly extending tube disposed toward the front of the lighter body, flame adjustment wheel 607 and thumb adjustment actuator 615 which is connected to said flame adjustment wheel, mounting frame 614, windshield 621, nozzle actuating lever 616, and an igniter comprising flint spring 617, flint 618 and striker 620. (The striker 620 shown in the figures is different from the prior art strikers and contains elements of the invention described herein.)

The tube of the nozzle is connected in communicating relationship with the interior of the lighter body where, as mentioned above, fuel is stored. The nozzle may be moved from a lower position to an upper position. When the nozzle is in its lower position, fuel cannot be ejected from it. When the nozzle is in the upper position, fuel is ejected from it. In normal operation, a lighter's striker is moved and the rear of lever 616 is depressed virtually simultaneously which causes the nozzle to be raised and a spark to be created when the teeth of the striker fictionally engage the flint 618. The spark ignites the fuel and a flame is maintained so long as the rear of the lever is continued to be depressed downward.

Figure 3:
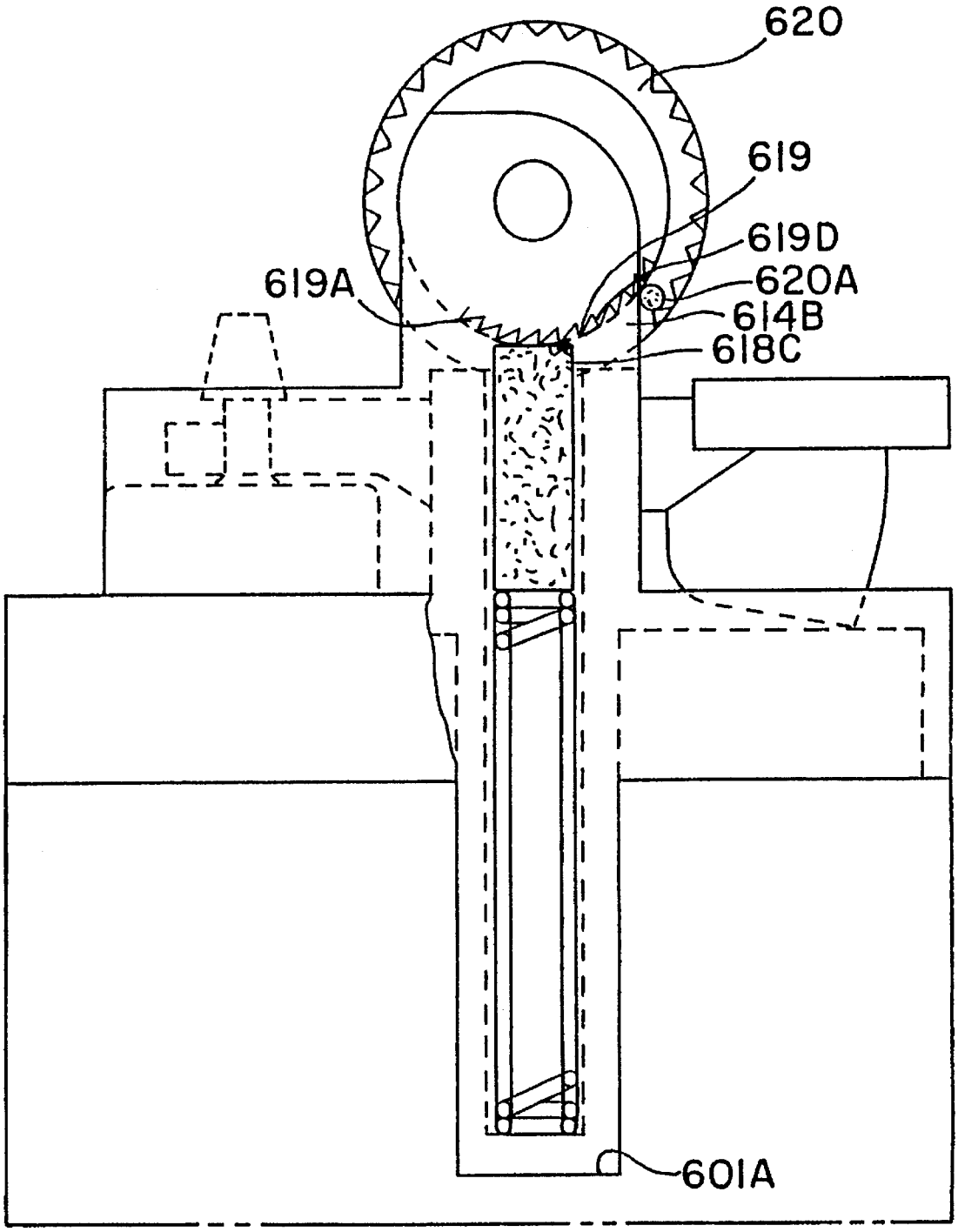
FIG. 3 is a partial side elevational view of the lighter of the first embodiment of the present invention, partially broken away and sectioned, illustrating the lighter of the first embodiment of the present invention in its safety position.
Figure 5:
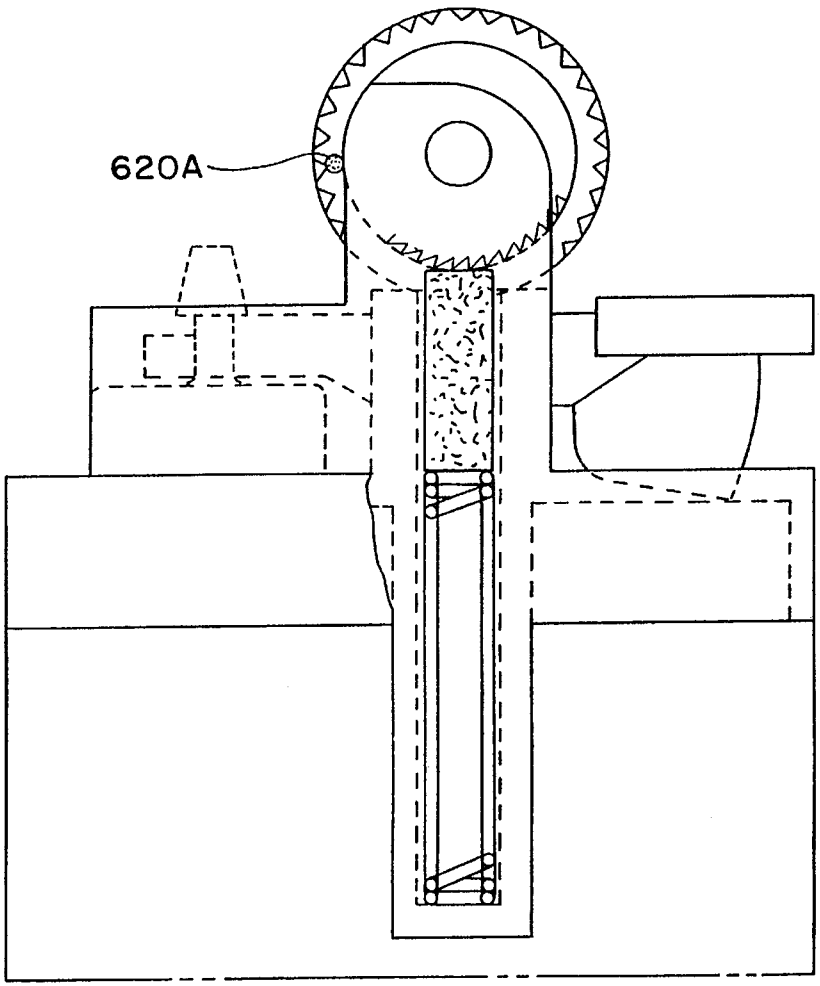
FIG. 5 is a partial side elevational view of the lighter of the first embodiment of the present invention, partially broken away and sectioned, illustrating the lighter in its operational condition.
Figure 4:
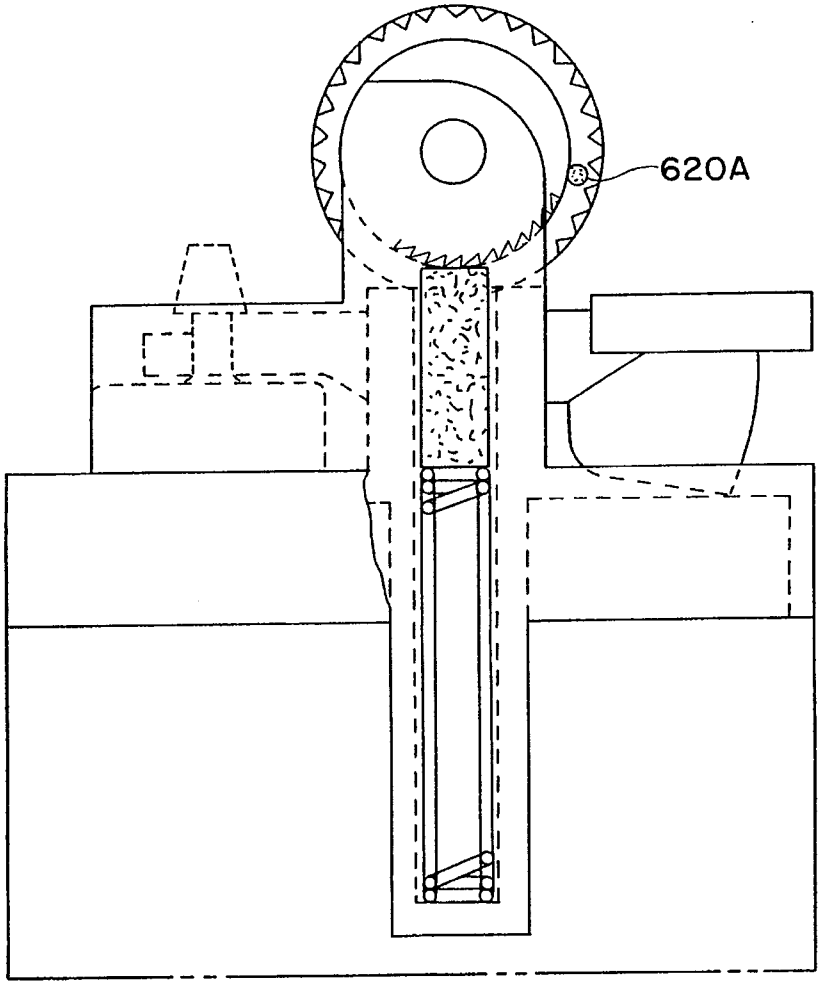
FIG. 4 is a partial side elevational view of the lighter of the first embodiment of the present invention, partially broken away and sectioned, illustrating the lighter of the present invention as it is being released from its safety position.

Illustrated in FIGS. 1 through 8 are elements forming the safety means of the first embodiment of the present invention. Striker 620 is formed in the shape of a wheel as in conventional lighters. It is mounted on frame 614 with the wheel's axis 620B fitting into holes 614D. Flint 618 and flint spring 617 are mounted in hole 601A of the lighter body in the conventional fashion so as to urge the flint 618 toward protuberances 619 which are disposed, in the first embodiment of the invention, about a circle on the striker wheel. This circle forms a periphery of the wheel inward of the striker wheel thumb grips 620C. The protuberances 619 are a series of sawtooth-shaped teeth, each having a first surface 619A which is substantially perpendicular to the tangent to the circle from which the protuberances extend. This first surface faces in the clockwise direction as the lighter is viewed from the side shown in FIGS. 3–5. Each tooth also has a second surface, 619D, which slopes toward the counter-clockwise direction of the wheel when the lighter is viewed from its side with the front (or nozzle) end of the lighter toward the left as shown in FIGS. 3–5.

Figure 6:
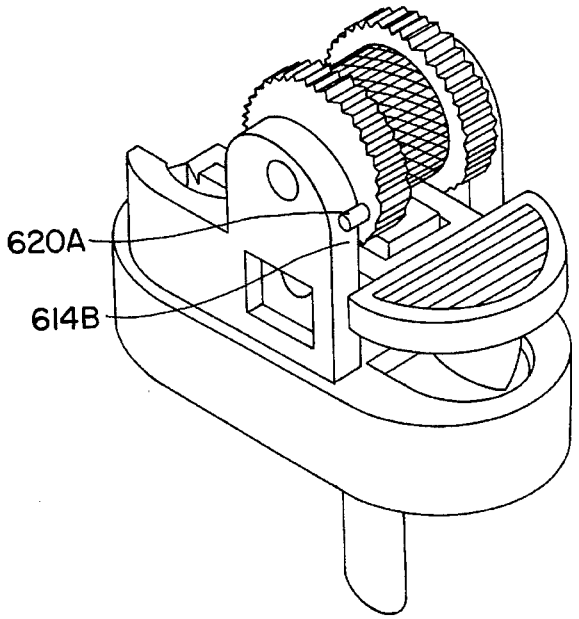
FIG. 6 is a perspective view of the inventive aspects of the first embodiment of the invention shown in its safety position.
Figure 7:
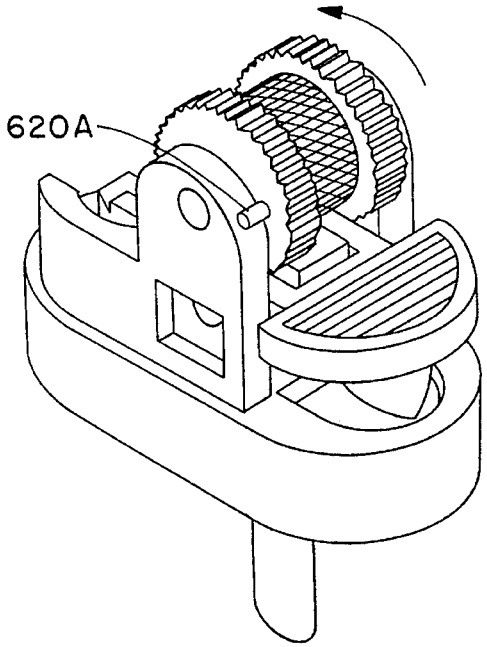
FIG. 7 is a perspective view of the inventive aspects of the first embodiment of the invention as it is being released from its safety position.

The striker wheel may be rotated in the clockwise direction (the first direction) or in the counter-clockwise direction (the second direction) until stopper 620A mounted on striker 620 comes into engagement with the mounting frame. Because of the shape of the teeth, sparks may be created as the striker wheel is rotated in the clockwise direction and the first surface 619A of the teeth come into engagement with the top (or engagement) end 618C of the flint. The range of motion in the first, or clockwise direction, is terminated when stopper 620A comes into abutting relationship with the mounting frame at point 614B, as shown in FIGS. 3 and 6. Once the stopper 620A comes into contact with the mounting frame at point 614B, clockwise movement of the striker wheel is prohibited and sparks can no longer be created. When the striker wheel is in such position, as shown in FIGS. 3 and 6, the lighter is in a safety condition and the fuel in the lighter can not be accidentally lighted or lighted by a child without a series of complicated movements taking place first.

As can be seen, stopper 620A is a projection which extends outward from striker wheel 620 and it is positioned such that it will come into contact with a stationary part of the lighter, in this instance, mounting frame 614.

Figure 8:
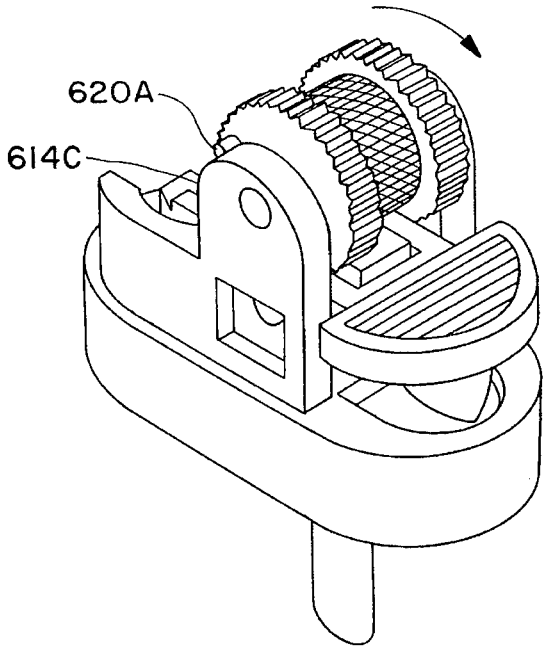
FIG. 8 is a perspective view of the inventive aspects of the first embodiment of the invention shown in its operational condition.

When the user of the lighter desires to light the lighter, he must turn the striker wheel in the counter-clockwise direction (the beginning of such movement being illustrated in FIGS. 4 and 7) until the stopper 620A has preferably reached point 614C on the mounting frame. At this point the striker wheel can no longer be turned in the counter-clockwise direction and, as illustrated in FIGS. 5 and 8, it is ready to be again turned in the clockwise direction to create a spark. As the striker wheel is being turned in the counter-clockwise direction, no sparks are created because the first surface of the striker wheel's teeth do not strike the engagement end of the flint. Instead, the second surface of each teeth, which slopes gradually backward in the counter-clockwise direction from the apex of the tooth toward the base of the tooth, is the surface which comes into contact with the engagement end of the flint. Therefore, even though flint spring 617 continues to urge the flint into engagement with the striker wheel's teeth, no sparks are created because the second surface of the teeth when moving in a counter-clockwise direction strike the engagement end of the flint virtually without friction (or with such little friction as to be unable to create a spark).

FIGS. 9 though 13 illustrate the second embodiment of the invention. As can be seen, the stopping means which in the first embodiment was comprised of stopper 620A takes on a different form in the second embodiment.

In the second embodiment, the protuberances or teeth 619 are not disposed about a circle whose center is axis 620B; instead protuberances or teeth 619 are disposed on an arc which is centered about axis 620B. The opening of that arc is referenced by numeral 620D. The opening of the arc is bounded on one side by tooth 619B which is at the end of the series of teeth or protuberances 619 which is furthest along in the clockwise, or first, direction, and on the other side by tooth 619C which is furthest along in the counter-clockwise, or second, direction among the series of protuberances 619.

The opening in the arc is at least as wide as the width of the flint 618 so that when the arc's opening is superimposed over the flint, the engagement end 618C of the flint can fit into the opening of the arc as shown in FIGS. 11 and 11-A. When the striker wheel is in this position it is in its safety position. The striker wheel cannot be moved in the clockwise direction because the first surface of tooth 619B is in abutting relationship with the portion of the engagement end of flint 618 which is designated by numeral 618B. It is also somewhat difficult to rotate the wheel in the counter-clockwise direction because the portion of the engagement end of the flint designated by reference numeral 618A abuts against the portion of the second surface of tooth 619C near its base. However, because of the gradual slope of the second surface of tooth 619C, movement in the counter-clockwise direction is not impossible.

Figure 13:
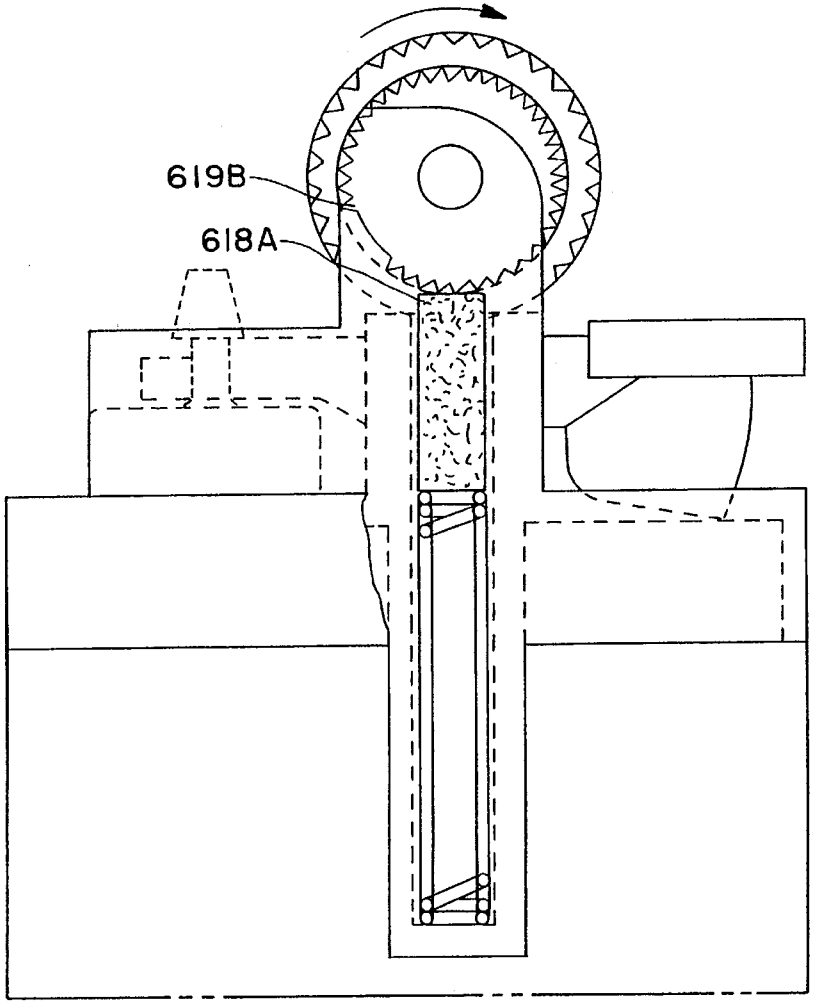
FIG. 13 is a partial side elevational view of the lighter of the second embodiment of the present invention, partially broken away and sectioned, illustrating the lighter in its operational condition.
Figure 12:
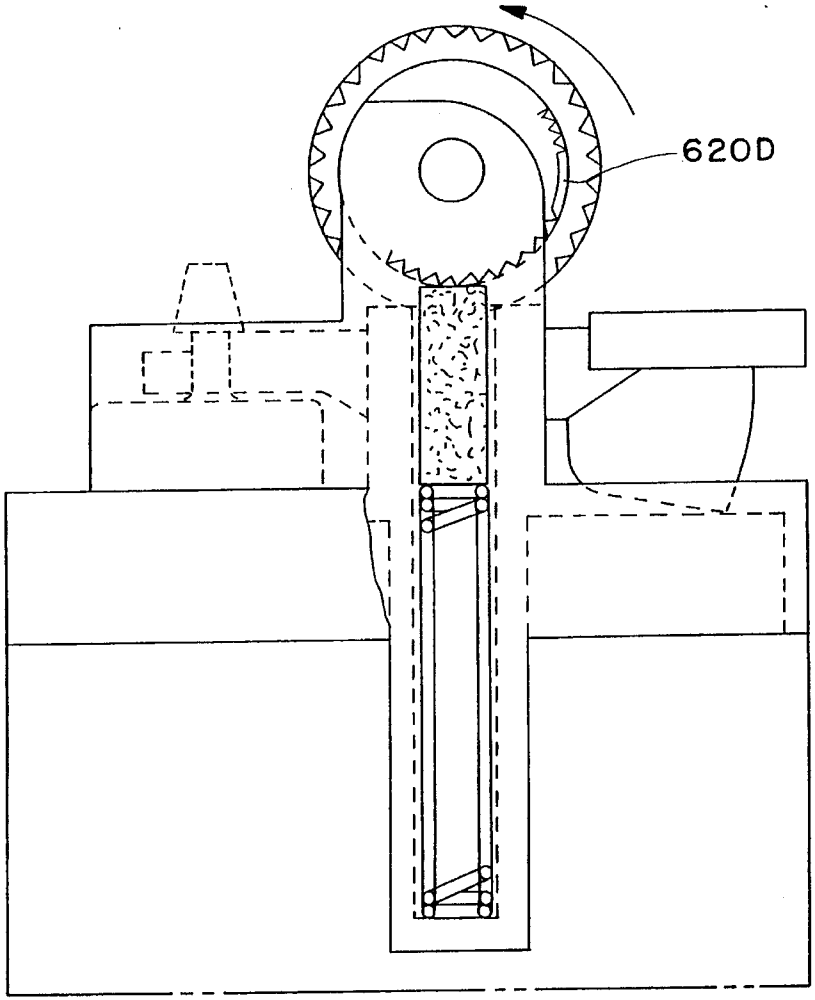
FIG. 12 is a partial side elevational view of the lighter of the second embodiment of the present invention, partially broken away and sectioned, illustrating the lighter of the present invention as it is being released from its safety position.

So, for the user to make the lighter operational, he rotates the striker wheel in the counter-clockwise direction as shown in FIG. 12 until the wheel is moved to approximately the same position as shown in FIG. 13.

At that point, the user can then rotate the striker wheel in the clockwise direction thereby creating a spark as the first surfaces of teeth 619 strike the engagement end of flint 618 while the striker wheel is being rotated in the clockwise direction. That clockwise directional movement will cease once the opening 620D in the arc is superimposed over the engagement end of the flint, and tooth 619B comes into stationary abutting relationship with the portion 618B of the flint. Note that as the flint is used, its engagement end will become concave in shape, thereby increasing the retention of the striker wheel in the safety lock position shown in FIG. 11.

Above there has been described a unique safety lighter. It should be understood that various changes of the details, materials, arrangements of parts and uses which have been herein described and illustrated in order to explain the nature of the invention will occur to and may be made by those schooled in the art upon the reading of this disclosure, and such changes are intended to be included within the principles and scope of this invention.

I claim:

1. A lighter comprising fuel storage means for storing fuel and fuel delivery means for delivering fuel to an exterior face of the lighter, and a flint and a striker in operational proximity to said fuel delivery means, said striker being movable in first and second directions, said striker and said flint being engaged with each other so as to create means for igniting fuel when said striker is moved in said first direction and so as to not create said means for igniting fuel when said striker is moved in said second direction, said striker being capable of being moved up to a limit in said first direction, beyond which limit said striker is incapable of being moved in said first direction;

wherein said striker is a wheel, and wherein said wheel is rotatable about an axis in said first and second directions, wherein said first and second directions are opposite to each other, and wherein said wheel is capable of being rotated in said first direction up to, and not beyond, said limit;

wherein stopper means for preventing said striker from being rotated in said first direction beyond said limit is mounted on said wheel;

wherein said wheel comprises a series of protuberances disposed on said wheel in an arc of a circle centered approximately about said axis, said arc having first and second ends with said first end being disposed toward said first direction and said second end being disposed toward said second direction, said circle having an open portion lying between said first and second ends and which is not part of said arc and does not have said protuberances disposed thereon, said protuberances disposed on said wheel in said arc extending outward from said wheel toward said flint, and wherein said protuberances engage with said flint as said wheel is rotated in said first direction, and wherein said means for igniting fuel is a spark created as said protuberances engage with said flint as said wheel is rotated in said first direction;

wherein said series of protuberances comprises a stopper protuberance, said stopper protuberance being positioned farther in the first direction then any of the other protuberances in said series of protuberances, said stopper protuberance being directly adjacent said first end, and wherein said stopper protuberance is said stopper means;

wherein said flint comprises an engagement end which is engaged by said protuberances as said wheel is rotated in said first direction, said engagement end of said flint being sized so that it may fit in said open portion; and wherein said flint and said wheel are urged into constant contact with each other; wherein said engagement end of said flint fits into said open portion when said open portion and said engagement end of said flint are in superimposed relationship with each other, and wherein said stopper protuberance comes into stationary engagement with said flint when said engagement end of said flint is fitted into said open portion and said wheel is attempted to be rotated in said first direction.

2. The lighter in claim 1 wherein each protuberance in said series of protuberances comprises a base from which said protuberance extends outward from said wheel and an apex which is located opposite said base, and wherein each said protuberance further comprises a first surface which faces toward said first direction, said first surface having an inner edge located at said base and an outer edge located at said apex, and a second surface which slopes in said second direction from said apex gradually toward said base, whereby said first surface strikes said engagement end of said flint when said wheel is rotated in said first direction thereby creating said spark, whereby said first surface does not strike said engagement end of said flint when said wheel is rotated in said second direction, and whereby when said engagement end of said flint is fitted into said open portion, said wheel may be rotated in said second direction such that said engagement end of said flint is freed from being fitted into said open portion.

* * * * *